US010847936B2

(12) United States Patent
Tang et al.

(10) Patent No.: US 10,847,936 B2
(45) Date of Patent: Nov. 24, 2020

(54) CARD EDGE CONNECTOR WITH IMPROVED GROUNDING MEMBER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Wen-Jun Tang, Kunshan (CN); Zhuang-Xing Li, Kunshan (CN); Hai-Guo Sun, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/551,760

(22) Filed: Aug. 27, 2019

(65) Prior Publication Data

US 2020/0076135 A1 Mar. 5, 2020

(30) Foreign Application Priority Data

Aug. 28, 2018 (CN) ..... 2018 1 0985957
Aug. 28, 2018 (CN) ..... 2018 2 1390393 U

(51) Int. Cl.
*H01R 12/00* (2006.01)
*H01R 13/6597* (2011.01)
(Continued)

(52) U.S. Cl.
CPC ..... *H01R 13/6597* (2013.01); *H01R 12/73* (2013.01); *H01R 13/502* (2013.01)

(58) Field of Classification Search
CPC .... H01R 13/6594; H01R 12/52; H01R 13/41; H01R 12/716
(Continued)

(56) References Cited

U.S. PATENT DOCUMENTS 5,542,851 A * 8/1996 Chikano ..... H01R 13/6582 439/108
5,813,871 A * 9/1998 Grabbe ..... H01R 23/688 439/108
(Continued)

FOREIGN PATENT DOCUMENTS

CN 204858048 U 12/2015
CN 204858048 Y 12/2015
CN 106356676 A 1/2017

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

A card edge connector includes an elongate housing defining a card slot between an upper wall and a lower wall, two rows of terminals disposed in the upper and lower walls, and a retaining part. Each row includes a plurality of signal terminals and a plurality of grounding terminals, the terminals include contacting sections exposed upon the card slot, leg sections extending out the insulating housing and connecting sections joining with the contacting sections and the leg sections. The retaining part includes a grounding member and an insulating base inserting molded with the grounding member, the insulating base are retained with the insulating housing and located between the two rows of the terminals, the grounding member includes two rows of grounding fingers extending out the insulating base and contacting with the grounding terminals one by one.

16 Claims, 16 Drawing Sheets

(51) Int. Cl.
*H01R 13/502* (2006.01)
*H01R 12/73* (2011.01)

(58) Field of Classification Search
USPC ..... 439/607.36, 74, 607.05, 607.08
See application file for complete search history.

(56) References Cited

U.S. PATENT DOCUMENTS 5,904,581 A * 5/1999 Pope ..... H01R 12/716 439/74
6,077,121 A * 6/2000 Wu ..... H01R 12/712 439/607.05
6,250,935 B1 * 6/2001 Mochizuki ..... H01R 13/658 439/74
6,503,101 B1 * 1/2003 Yu ..... H01R 13/6597 439/607.36
6,692,273 B1 * 2/2004 Korsunsky ..... H01R 13/6591 439/108
6,884,094 B1 * 4/2005 Bernhart ..... H01R 13/28 439/101
7,632,107 B2 * 12/2009 Mizumura ..... H01R 23/68 439/74
8,888,506 B2 * 11/2014 Nishimura ..... H01R 12/7082 439/74
8,986,027 B2 * 3/2015 Nishimura ..... H01R 12/707 439/181
9,246,279 B2 * 1/2016 Kato ..... H01R 13/6596
9,455,530 B2 * 9/2016 Patel ..... H01R 13/652
10,490,920 B2 * 11/2019 Manickam ..... H01R 12/721
2005/0032400 A1 * 2/2005 Zhang ..... H01R 12/716 439/74
2005/0042924 A1 * 2/2005 Zhang ..... H01R 13/6582 439/607.36
2006/0063432 A1 * 3/2006 Chen ..... H01R 13/658 439/607.36
2006/0276061 A1 * 12/2006 Koguchi ..... H01R 12/725 439/74
2008/0207014 A1 * 8/2008 Takeuchi ..... H01R 12/716 439/74
2008/0305657 A1 * 12/2008 Midorikawa ..... H01R 43/0235 439/74
2009/0061655 A1 * 3/2009 Miyazaki ..... H01R 12/57 439/74
2010/0068900 A1 * 3/2010 Wu ..... H01R 12/716 439/74
2011/0092096 A1 * 4/2011 Jin ..... H01R 13/6471 439/607.05
2011/0263140 A1 * 10/2011 Sato ..... H01R 12/7052 439/74
2012/0064743 A1 * 3/2012 Qin ..... H01R 13/6471 439/92
2013/0012039 A1 * 1/2013 Nose ..... H01R 12/716 439/74
2013/0109214 A1 * 5/2013 Ching ..... H01R 12/707 439/328
2013/0337676 A1 * 12/2013 Hsueh ..... H01R 13/6597 439/350
2014/0170875 A1 * 6/2014 Shen ..... H01R 12/721 439/159
2014/0242845 A1 * 8/2014 Miki ..... H01R 12/724 439/629
2014/0273629 A1 * 9/2014 Canning ..... H01R 11/284 439/607.36
2015/0079816 A1 * 3/2015 Suzuki ..... H01R 12/7082 439/74
2015/0140840 A1 * 5/2015 Nishimura ..... H01R 13/6594 439/74
2015/0140841 A1 * 5/2015 Watanabe ..... H01R 43/18 439/74
2015/0207248 A1 * 7/2015 Takenaga ..... H01R 13/6582 439/74
2015/0236437 A1 * 8/2015 Briant ..... H01R 12/737 439/636
2015/0340817 A1 * 11/2015 Li ..... H01R 12/712 439/62
2016/0190719 A1 * 6/2016 Brzezinski ..... H01R 12/73 439/74
2019/0214755 A1 * 7/2019 Manickam ..... H01R 13/648

* cited by examiner

CARD EDGE CONNECTOR WITH IMPROVED GROUNDING MEMBER

BACKGROUND OF THE INVENTION

1. Field of the Invention

The invention relates to a card edge connector with at least one grounding member.

2. Description of Related Art

Chinese Utility patent issued No. CN204858048U discloses a card edge connector, which includes an insulating housing, two rows of terminals and a grounding module. A U-shape grounding plate is assembled around an insulating base, thereby forming the grounding module. The grounding module is assembled between the two rows of terminals and contacting with grounding terminals of the terminals. Understandingly, there is a large risk that the grounding piece disengages from the insulting base.

It is desired to have a card edge connector with improved grounding member.

SUMMARY OF THE INVENTION

Accordingly, an object of the present invention is to provide a card edge connector. The card edge connector comprises an elongate housing defining a card slot between an upper wall and a lower wall, two rows of terminals disposed in the upper and lower walls, and a retaining part. Each row comprises a plurality of signal terminals and a plurality of grounding terminals, the terminals comprises contacting sections exposed upon the card slot, leg sections extending out the insulating housing and connecting section joining with the contacting section and the leg section. The retaining part comprises a grounding member and an insulating base inserting molded with the grounding member, the insulating base are retained with the insulating housing and located between the two rows of the terminals, the grounding member comprises two rows of grounding fingers extending out the insulating base and contacting with the grounding terminals one by one.

Other objects, advantages and novel features of the invention will become more apparent from the following detailed description when taken in conjunction with the accompanying drawings.

DETAILED DESCRIPTION OF THE PREFERRED EMBODIMENT

Figure 1:
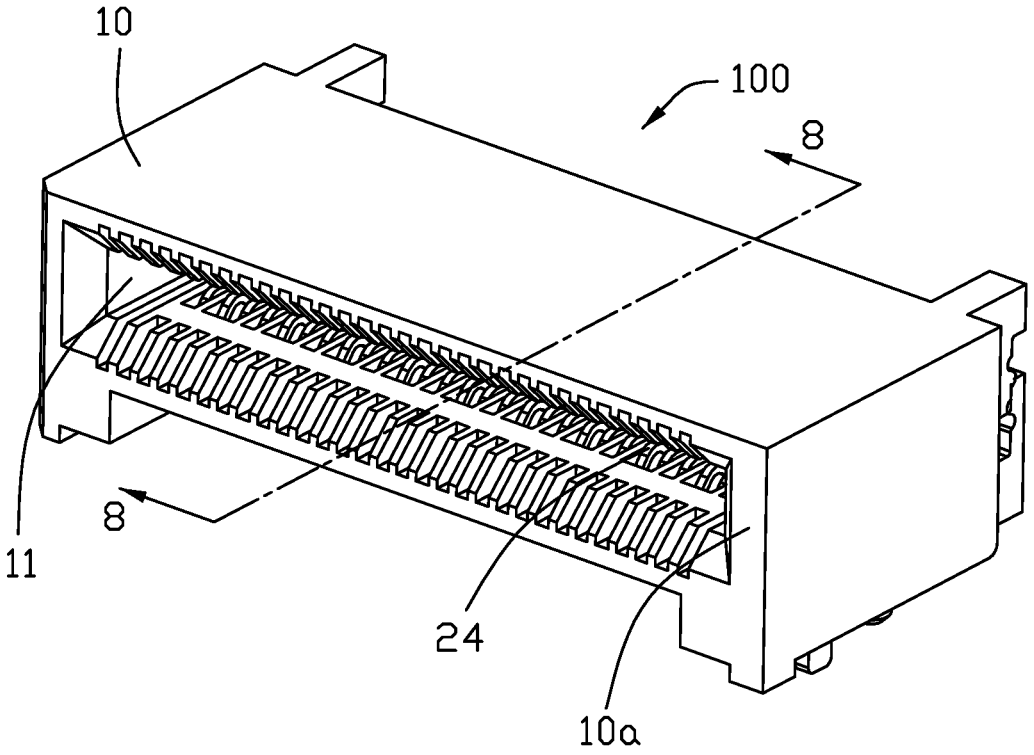
FIG. 1 is a front and top perspective view of a card edge connector of a first embodiment according to the invention.

Reference will now be made to the drawing figures to describe a preferred embodiment of the present invention in detail.

As shown in FIGS. 1 through 8, a card edge connector 100 of an embodiment of this present invention is illustrated, which includes an elongate insulating housing 1, two rows of conductive terminals 2 and a retaining/grounding part 3 retained on the housing 1. The insulating housing 1 defines a card slot 11 between two long walls 10, i.e., an upper wall and a lower wall, and two short walls 10*a* commonly surrounding the card slot 11 opening forwards. Each row of terminals 2 include a plurality of signal terminals 22 and a plurality of grounding terminals 21, a pair of signal terminals 22 are located between two grounding terminals 21, and a grounding terminal is located between two pairs of signal terminals in this embodiment. The retaining part 3 is retained and disposed between the two rows of terminals 20. The retaining part 3 includes a grounding member/piece 31 and an insulating base or positioning base 32 inserted with the grounding member 31, the grounding member 31 is used to contact with all of the grounding terminals 21, the insulating base 32 is used to position and retain the retaining part 3 to the insulating housing 1. Therefore, the grounding member 31 is fitly retained in the retaining part 30 and then fitly retained with the insulating housing 1 for avoiding loose.

Figure 3:
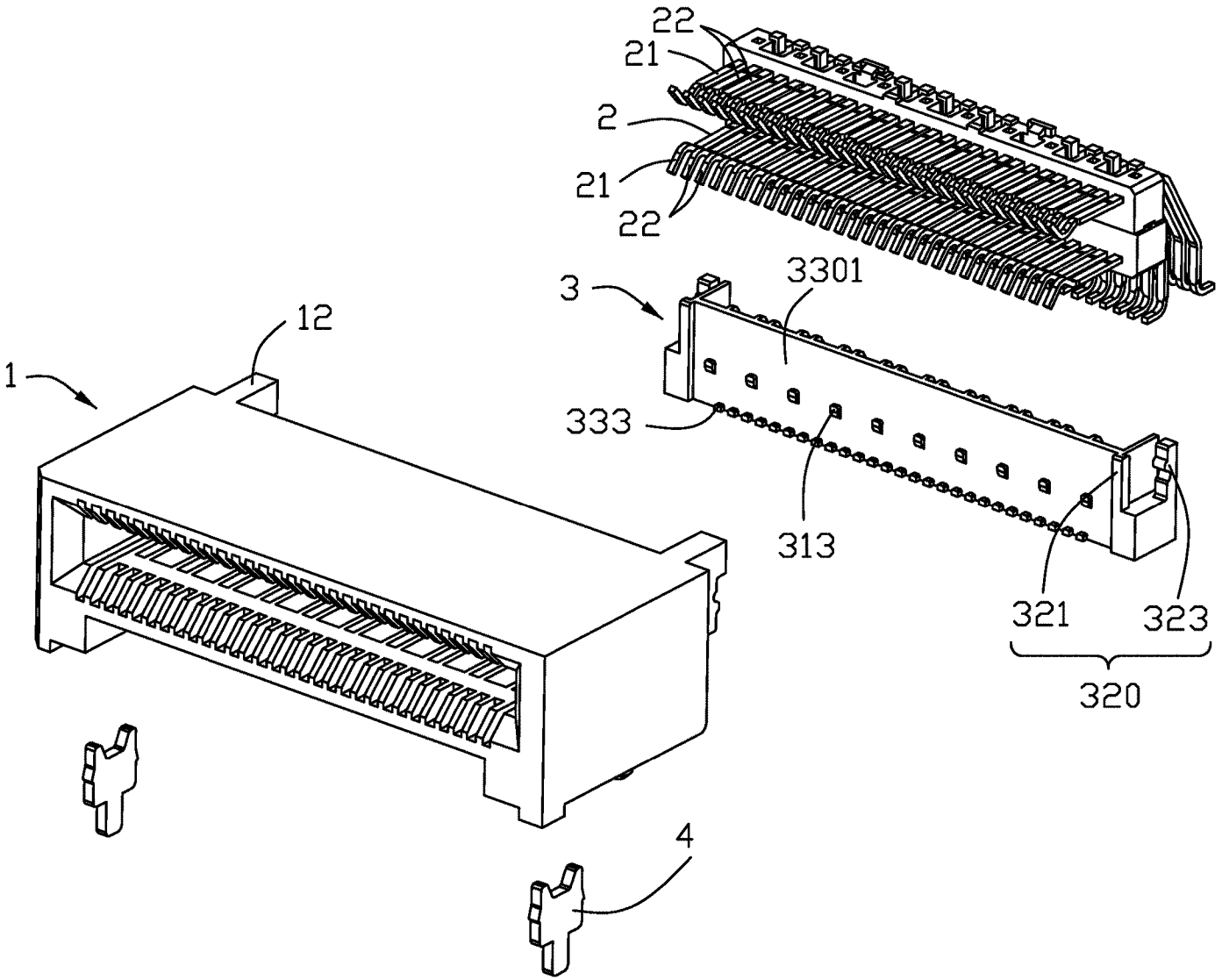
FIG. 3 is an explode perspective view of the card edge connector shown in FIG. 1.
Figure 4:
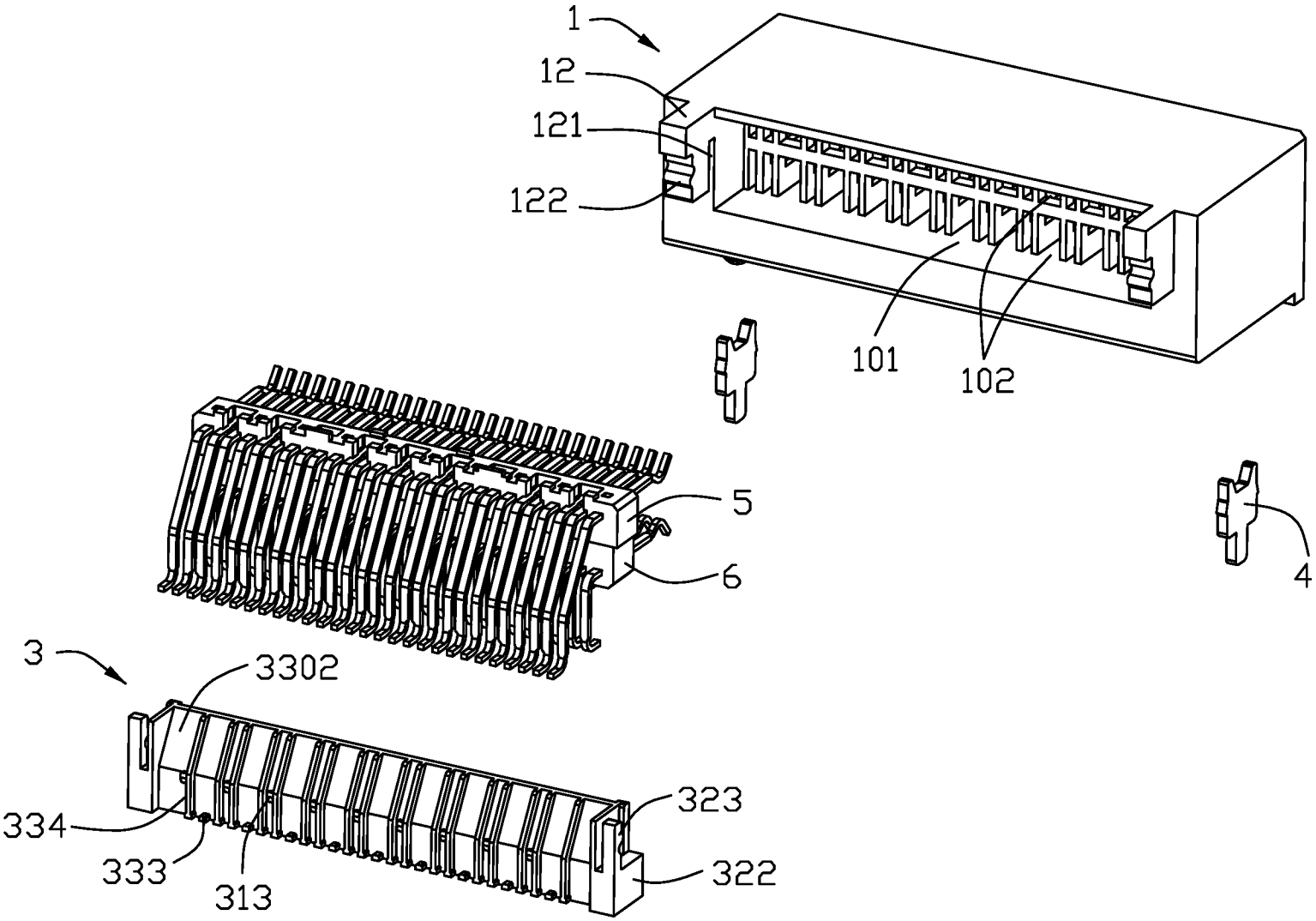
FIG. 4 is an explode perspective view of the card edge connector shown in FIG. 2.
Figure 5:
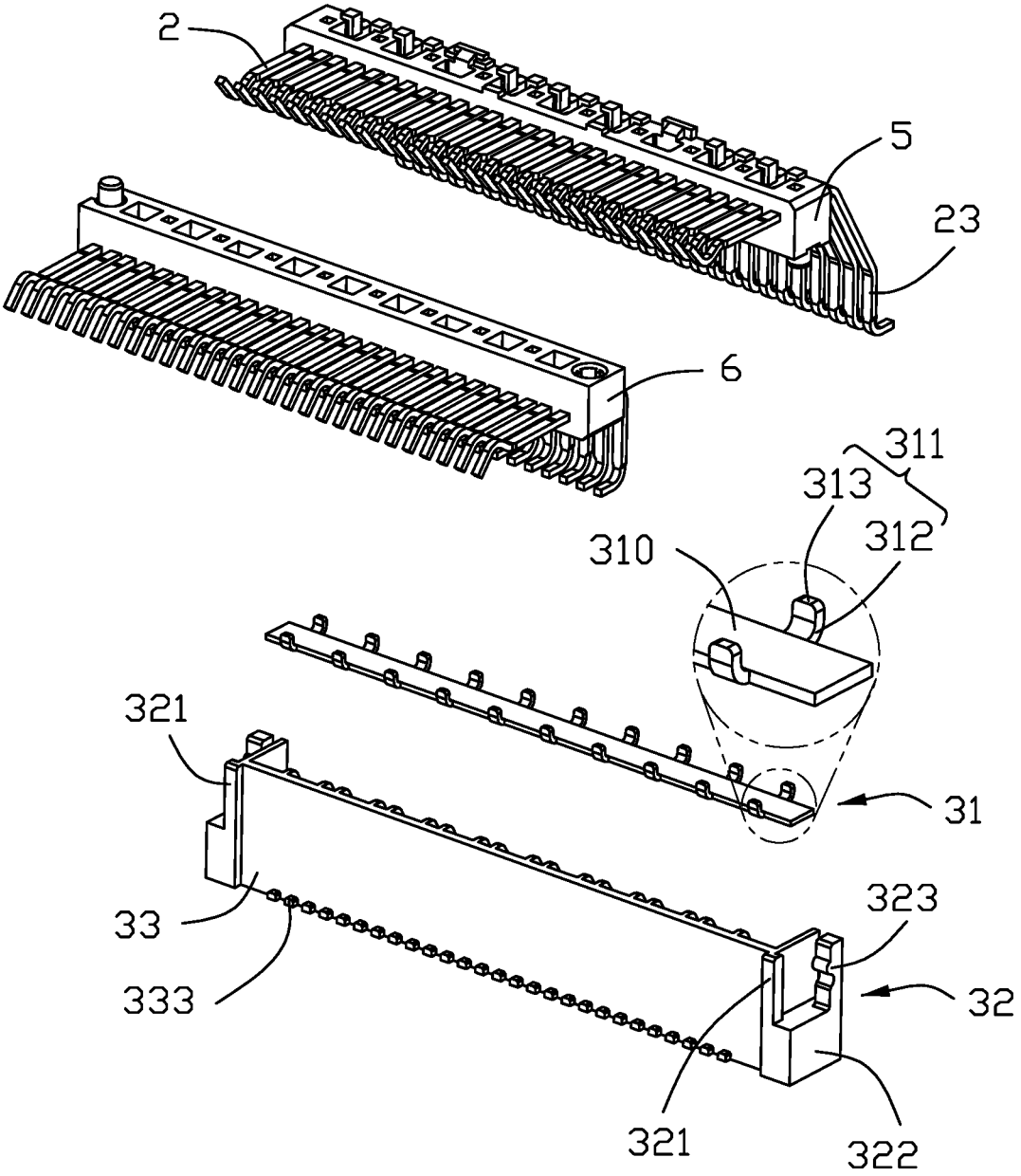
FIG. 5 is a further exploded perspective view of the card edge connector shown in FIG. 3, and the insulating housing is removed.
Figure 8:
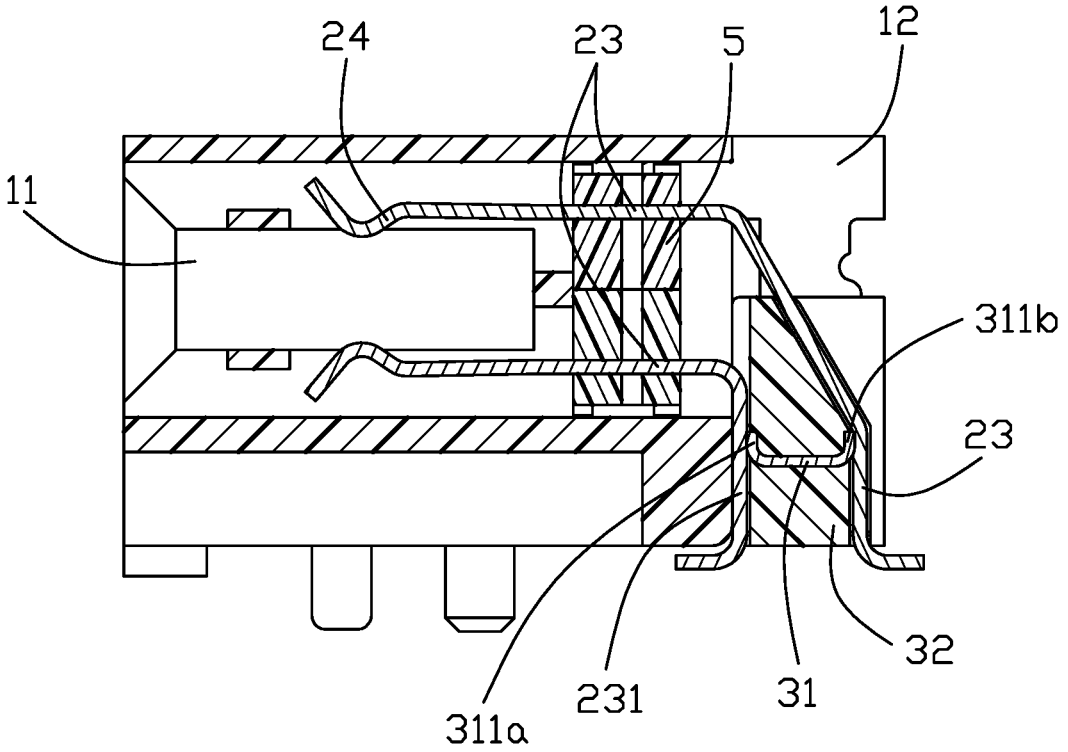
FIG. 8 is a cross-sectional view of the car edge connector taking along lines 8-8 in FIG. 1.
Figure 9:
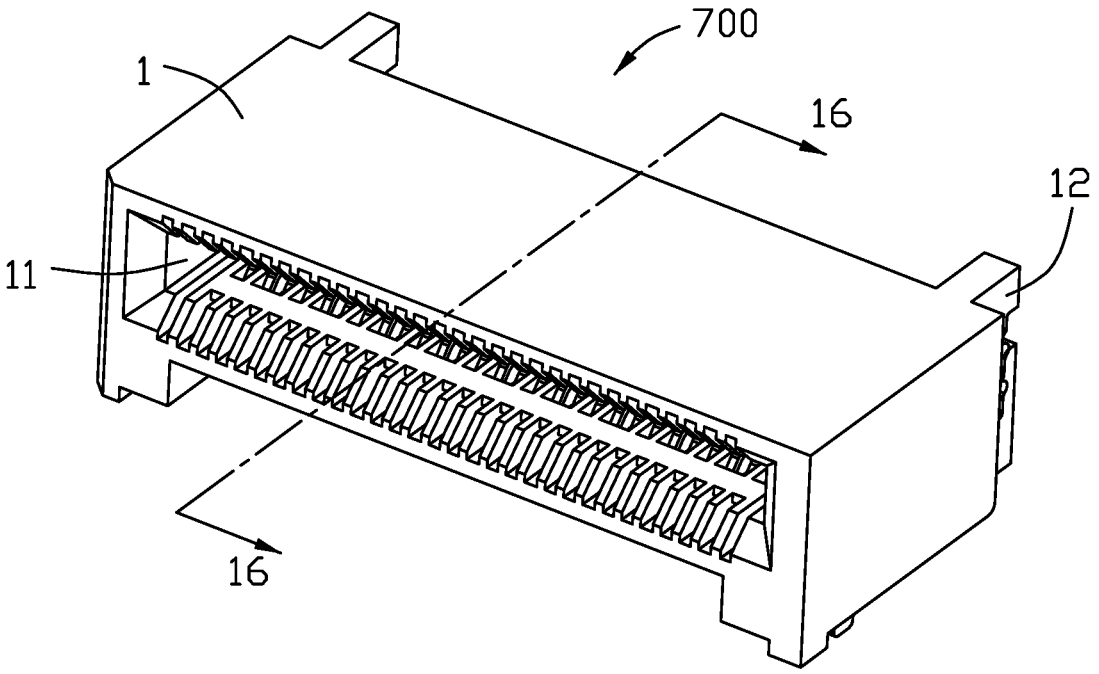
FIG. 9 is a front and top perspective view of a card edge connector of a second embodiment according to the invention.
Figure 10:
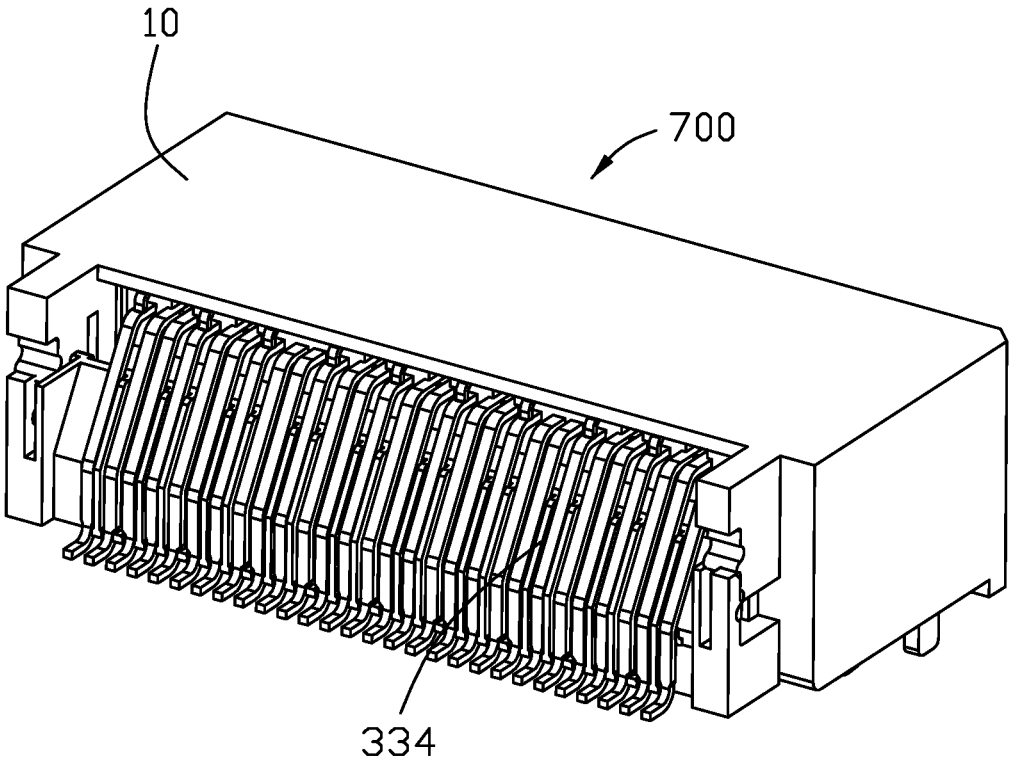
FIG. 10 is a rear and top perspective view of the card edge connector shown in FIG. 9.

Referring to FIGS. 3 through 5, the grounding member 31 includes an elongate plate portion 310 and a plurality grounding fingers 311 extending from opposite elongate side of the plate portion 310 so as to each contact with corresponding grounding terminal 21. The grounding finger 311 includes a bending portion 312 bending upwards from the elongate side and a contacting portion 313 upright from the bending portion 312. The contacting portions 313 are exposed upon an exterior of the insulating base 32, and the bending portions are embedded in the insulating portion 32. As shown in FIG. 8, two rows of terminals 2 includes upright sections 231 exposed upon opposite sides of the insulating base 32, so that the contacting contacts 313 of the grounding member 31 touch the vertical sections 231 one by one. The place of the grounding member 31 in the insulating base 32 can be adjusted response to the height of the upright sections 231 of terminals 2 and the contacting points of the grounding terminals 21 with the upright sections 231 to achieve a best grounding performance.

Figure 7:
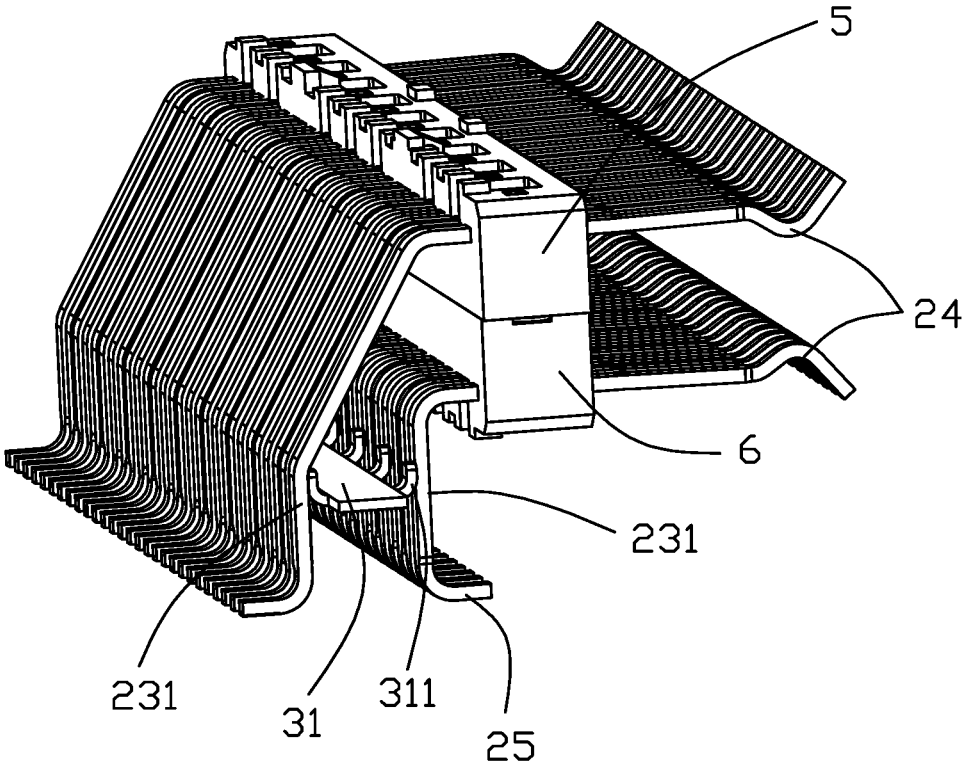
FIG. 7 is a perspective view of the two terminal modules sandwiching the grounding member.

As best shown in FIGS. 7 and 8, each terminal 2 includes a contacting section 24 extending in the card slot 11, a leg portion 25 extending out the insulating housing 1 to be soldered with the printed circuit board (PCB), and a connecting section 23 connecting with the contacting section 24 and leg section 25. Front parts and rear parts of the connecting sections 23 extend out the insulating base 32. The upper rows of terminals are retained in an insulator 5 as to form an upper terminal module, the lower rows of the terminals are retained in an insulator 6 to form a lower terminal module, the upper and lower terminal modules are assembled together to form a terminal module assembly. Alternatively, the two rows of terminals can be inserting molded in a same larger insulator.

As best shown in FIG. 4, the insulating housing 1 defines a receiving cavity 101 at the rear end thereof and terminal grooves 102 opening through the card slot 11 and receiving cavity 101. After the first and the second terminal modules are assembled to the insulating housing 1, the first and second insulating block 5, 6 are retained in the receiving cavity 101 and the contacting sections 24 cross the terminal grooves 102 and exposed upon the card slot 11. A pair of board locks 4 is retained in the insulating housing 1 at opposite ends of the card slot and extends out mounting legs to be mounted in a printed circuit board (not shown).

Figure 2:
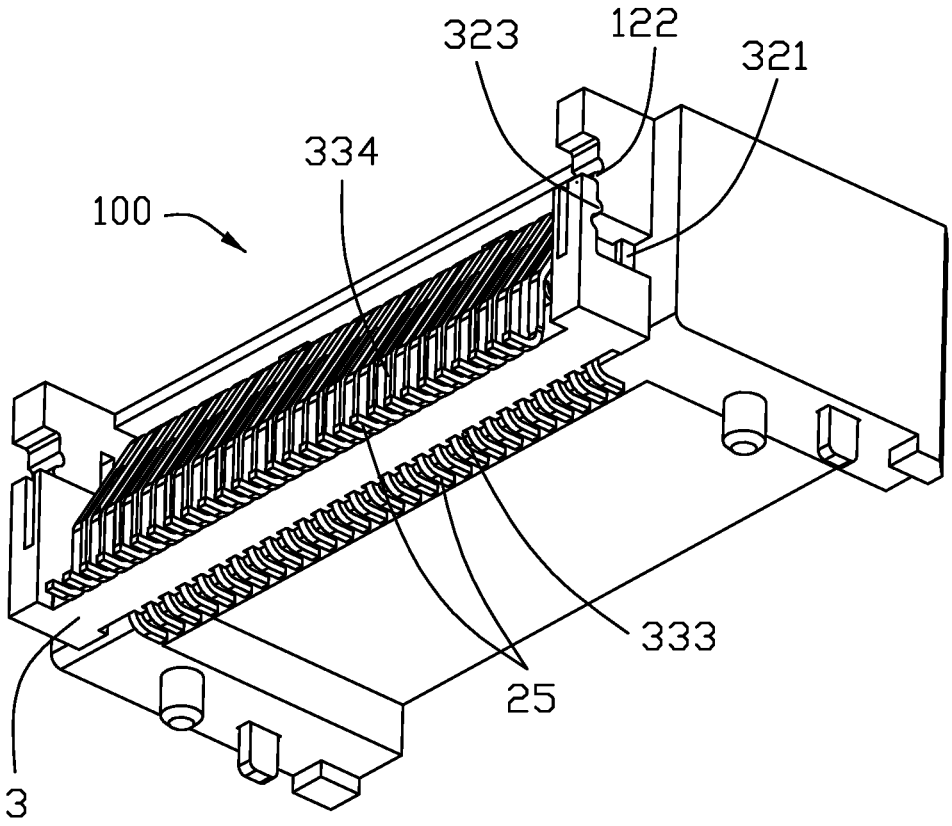
FIG. 2 is a rear and bottom perspective view of the card edge connector shown in FIG. 1.

As best shown FIGS. 3 through 5, the insulating housing 1 includes two first retaining portions 12 extending rearward from a rear end thereof and located at opposite ends of the receiving cavity 101. The top face of first retaining portions 12 is aligned with the top face of the insulating housing 1. The first retaining portion 12 defines a slot 121 at a root to the retaining portion 12, the two slots 121 opens downwards and cross an inside lateral side thereof. Each first retaining portion further defines projections 122 at a rear end thereof. The insulating base 32 includes a board base 33 with a rear surface 3302 and a front surface 3301, which is used to be inserted between and separating the two rows of the connecting sections 23. The insulating base 33 defines two upright ribs 321 at opposite ends of rear surface 3302 of the board base 33 and two locking posts 323 at opposite end of the board base 33 and separating from the board base 33. After the retaining part 30 assembled upwards to the insulating housing 1, the ribs 321 are inserted and interference with the slots 121 and the locking posts 323 with projections are engaging with the projections 122 of the first retaining portions 12. The rib 321 and the locking post 323 functions as a second retaining portion 320 as best shown in FIG. 2. The locking posts 323 extend from step portions 322 at opposite ends thereof.

As best shown FIGS. 3 and 4, the contacting portions 313 of the grounding member 30 are exposed upon the front and rear surfaces 3301, 3302 of the board base 33. The front surface 3301 of the board base 33 defines bulges 333 at a bottom edge. The rear surface 3302 also defines bulges 333 at a bottom edge. The rear surface 3302 further defines partitioning ribs 334 extending in an upper to lower direction and the partition ribs 334 are united with corresponding bulges 33. The leg sections 25 are limited by two adjacent bulges 333 and the grounding terminals 21 of the upper row of terminals are limited by the partitioning ribs 334. Understandingly, as best shown in FIG. 8 the grounding fingers 311 are divided to a row of first grounding fingers 311*a* and a row of second grounding fingers 311*b*. One ends/bending portions 312 of the first grounding fingers are embedded in the insulating base 33 and another ends/contacting portions 313 are exposed upon a first/front surface 3301 of the insulating base 10. Similarly, one ends of the second grounding fingers are embedded in the insulating base 10 and another ends are exposed upon exposed upon a second/rear surface of the insulating base 33. The another ends of the first and second grounding fingers press against the connecting sections of grounding terminals, and the connecting sections of terminals are positioned along the first surface and the second surface, respectively. That is, the contacting portions penetrate out the opposite surfaces of the insulating base and other portions are retained in the insulating base.

Figure 6:
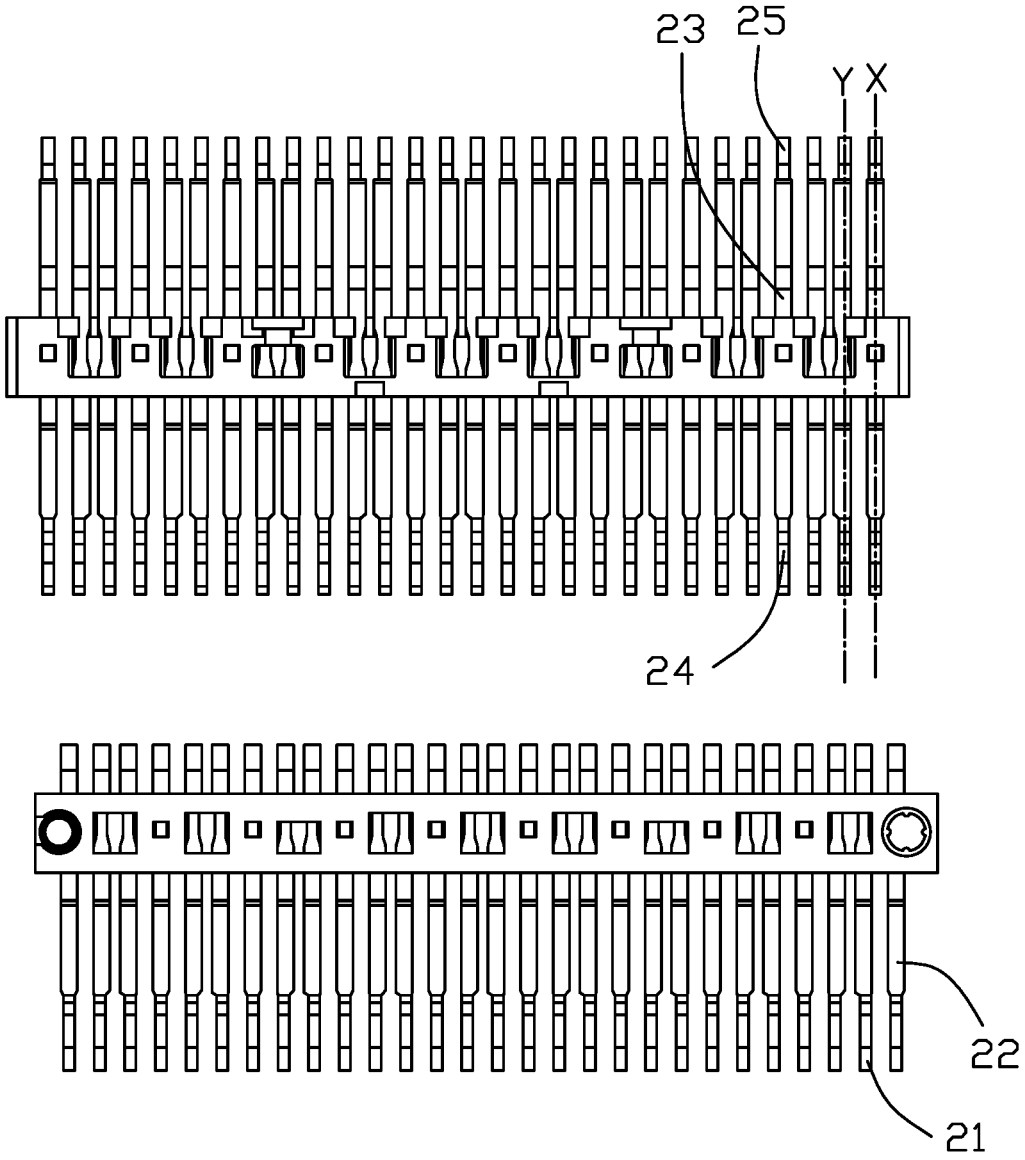
FIG. 6 is a top plan view of the two terminal modules shown in FIG. 5.

Referring to FIG. 6, the grounding terminals 22 are symmetrical about a center axis X while connecting sections 23 of the signal terminals 21 are off its center axis so that the distances between adjacent connecting sections 23 differs from the distances between adjacent contacting sections or leg sections.

Referring to FIGS. 9 through 16 illustrating a card edge connector 700 of another embodiment of this present invention, the card edge connector 700 is similar to the connector 100 of said first embodiment, except that the connector 700 is provided with a more/second grounding member 71 in addition to the grounding member 3 which can be named as the first grounding member. The same numerals referring to the same part of the connector to said first embodiments are used if necessary in this embodiment and descriptions of the same part are omitted. Only different parts of this embodiment are described hereinafter.

Figure 12:
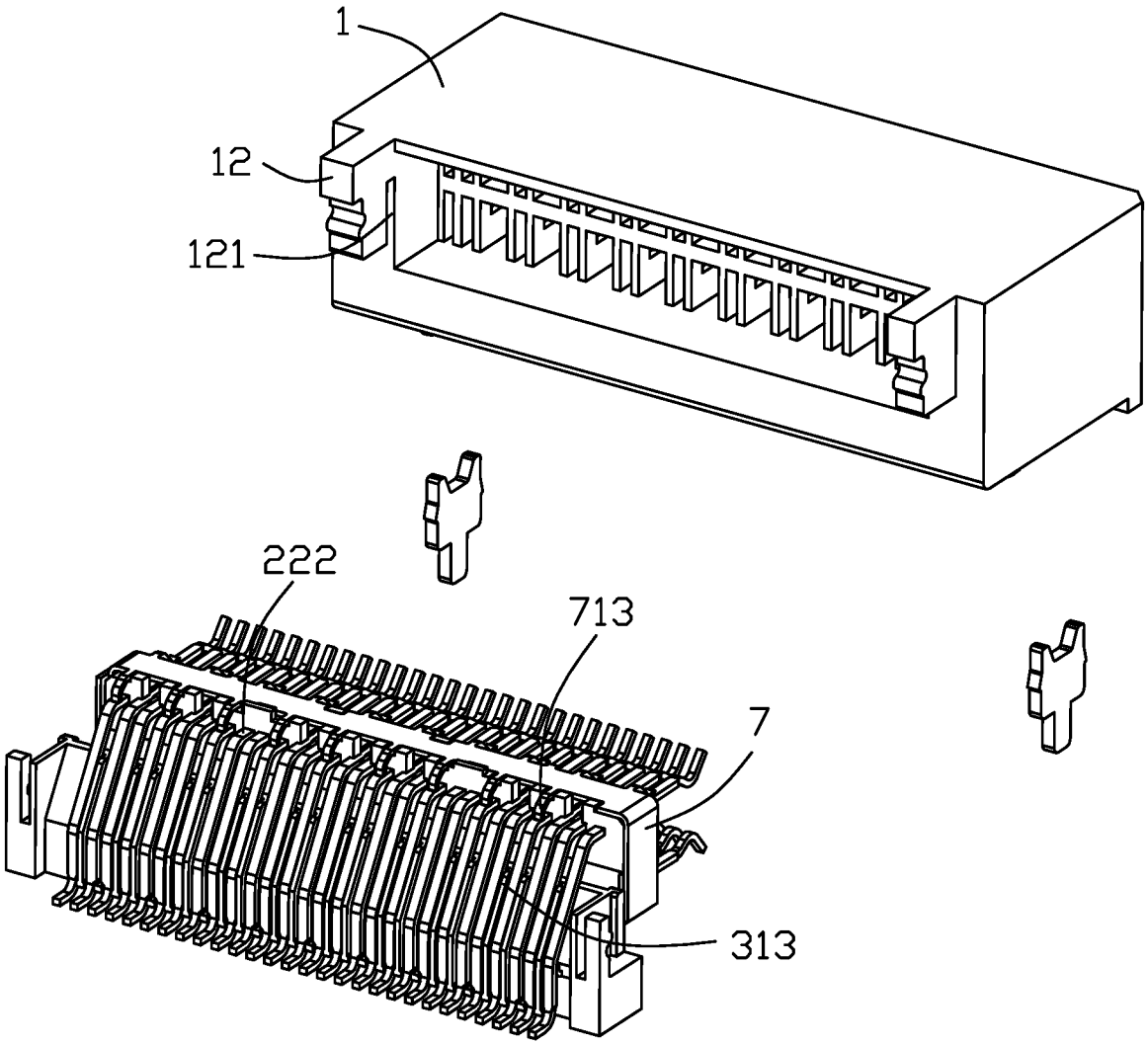
FIG. 12 is an explode perspective view of the card edge connector shown in FIG. 10.
Figure 15:
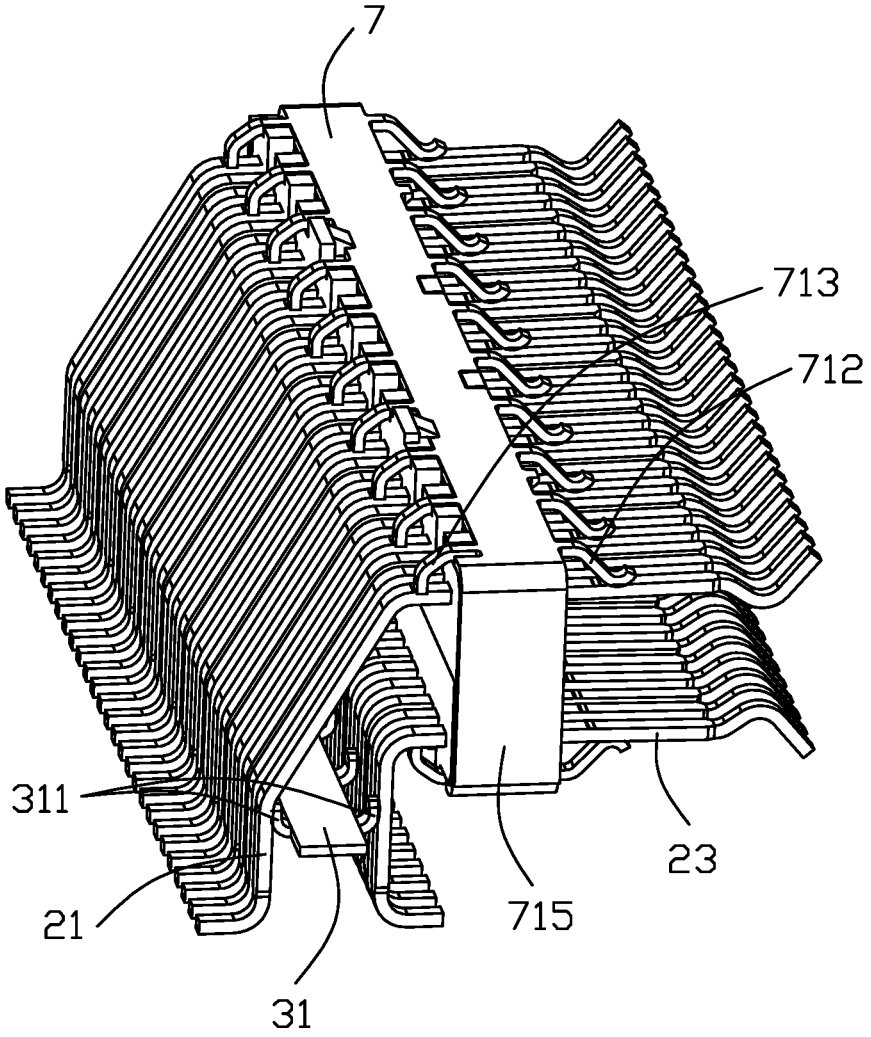
FIG. 15 is a perspective view of the two terminal modules sandwiching the two grounding members.
Figure 16:
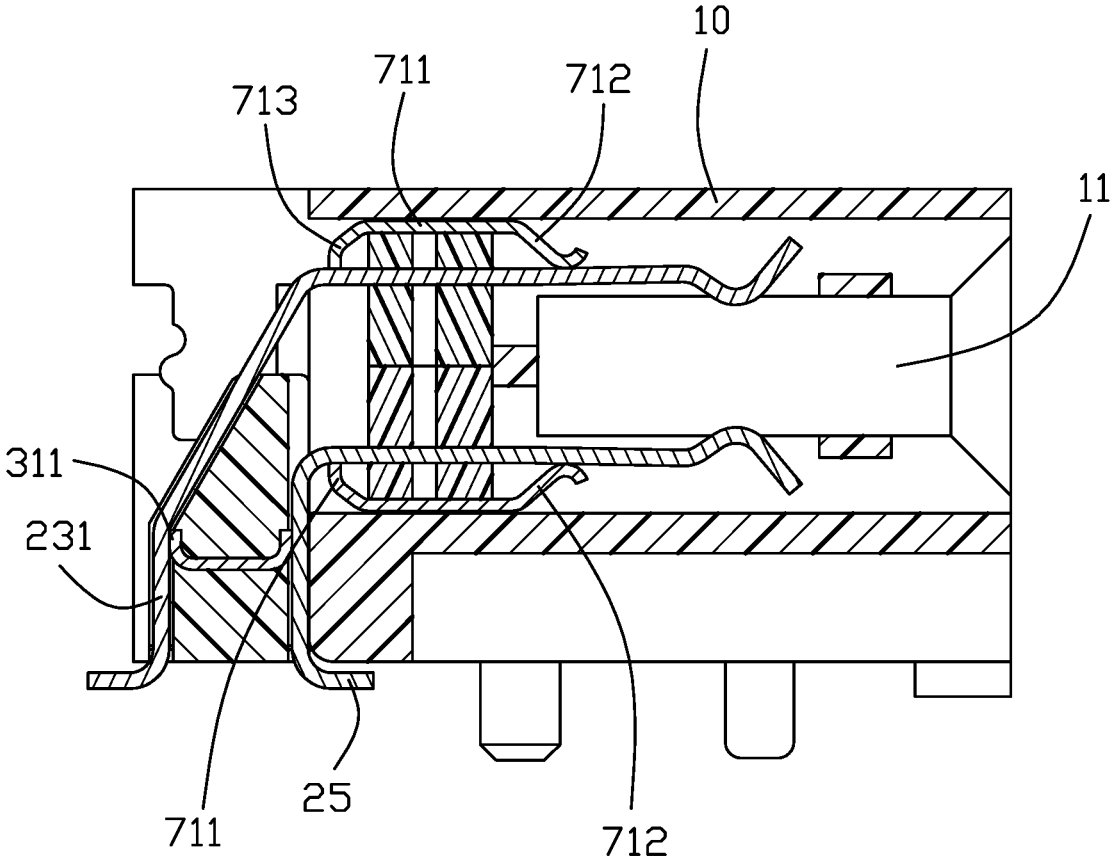
FIG. 16 is a cross-sectional view of the car edge connector taking along lines 16-16 in FIG. 9.

Referring to FIGS. 12 and 15, the terminals 2 extend out the front and rear surfaces of the insulator 5/6 to form two terminal modules 5*a*, 6*a*, and a second grounding member 7 is formed in a ring shape and surrounds four end surfaces perpendicular to the front and rear surfaces of the insulator and further contacts with all the grounding terminals 21 of the two rows of terminals 2, thereby improve the electrical performance of high-speed transmission. The second grounding member 7 defines a group of first contacting arms 712 and a group of second contacting arms 713, each first contacting arm 712 and corresponding second contacting arm 713 press against two points of a same grounding terminal 21. One of the two points is located in front of the front surface and another point is located at a rear side of rear surface of the insulator. Therefore, as best shown in FIG. 15, each grounding terminal 21 is contacted with three grounding points by the first grounding member 31 and the second grounding member 7. Each grounding member commonly connects all grounding terminals 21 of the two rows of terminals 2, to share a same grounding trace length.

Figure 13:
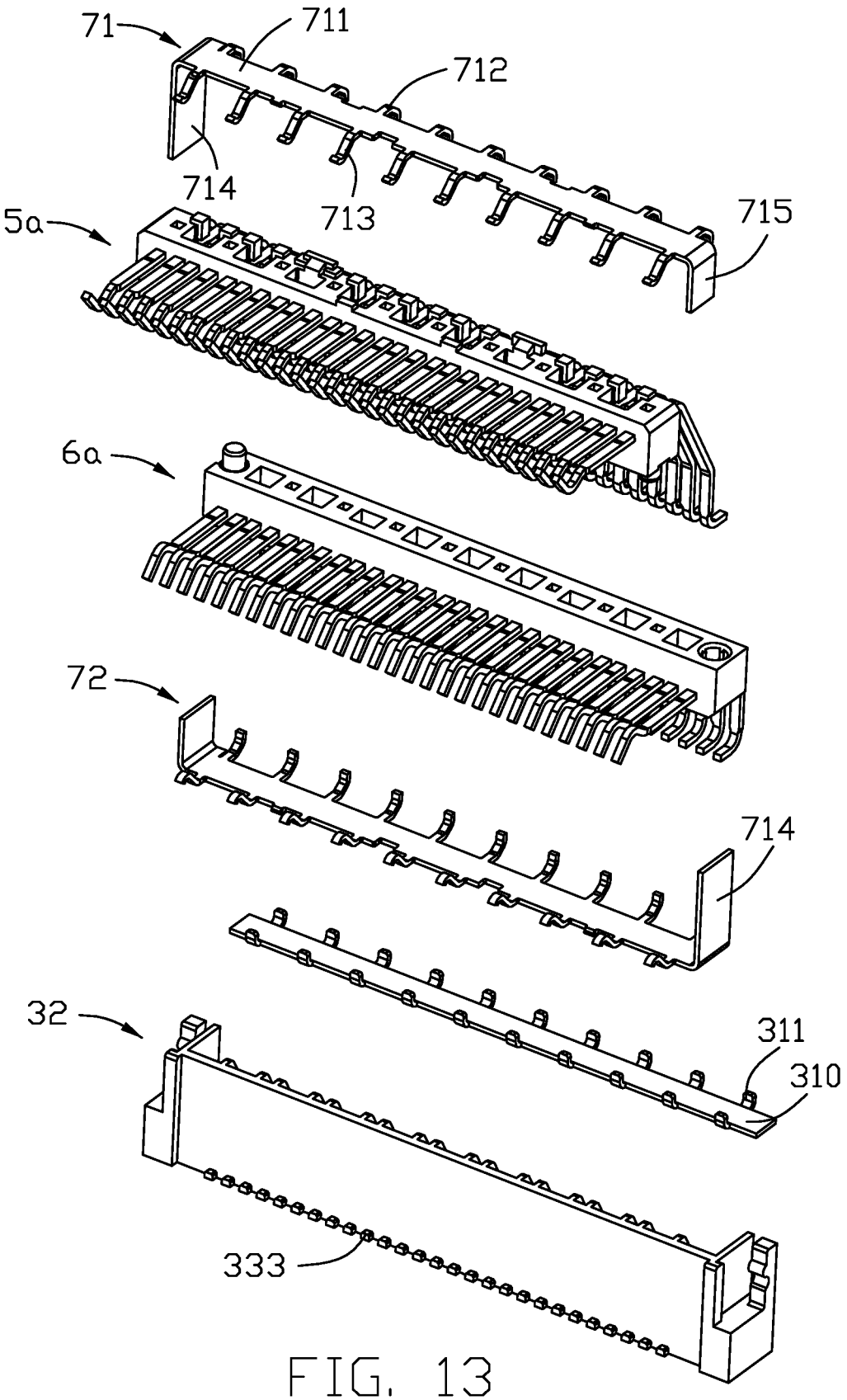
FIG. 13 is a further exploded perspective view of the card edge connector shown in FIG. 11, and the insulating housing is removed.
Figure 14:
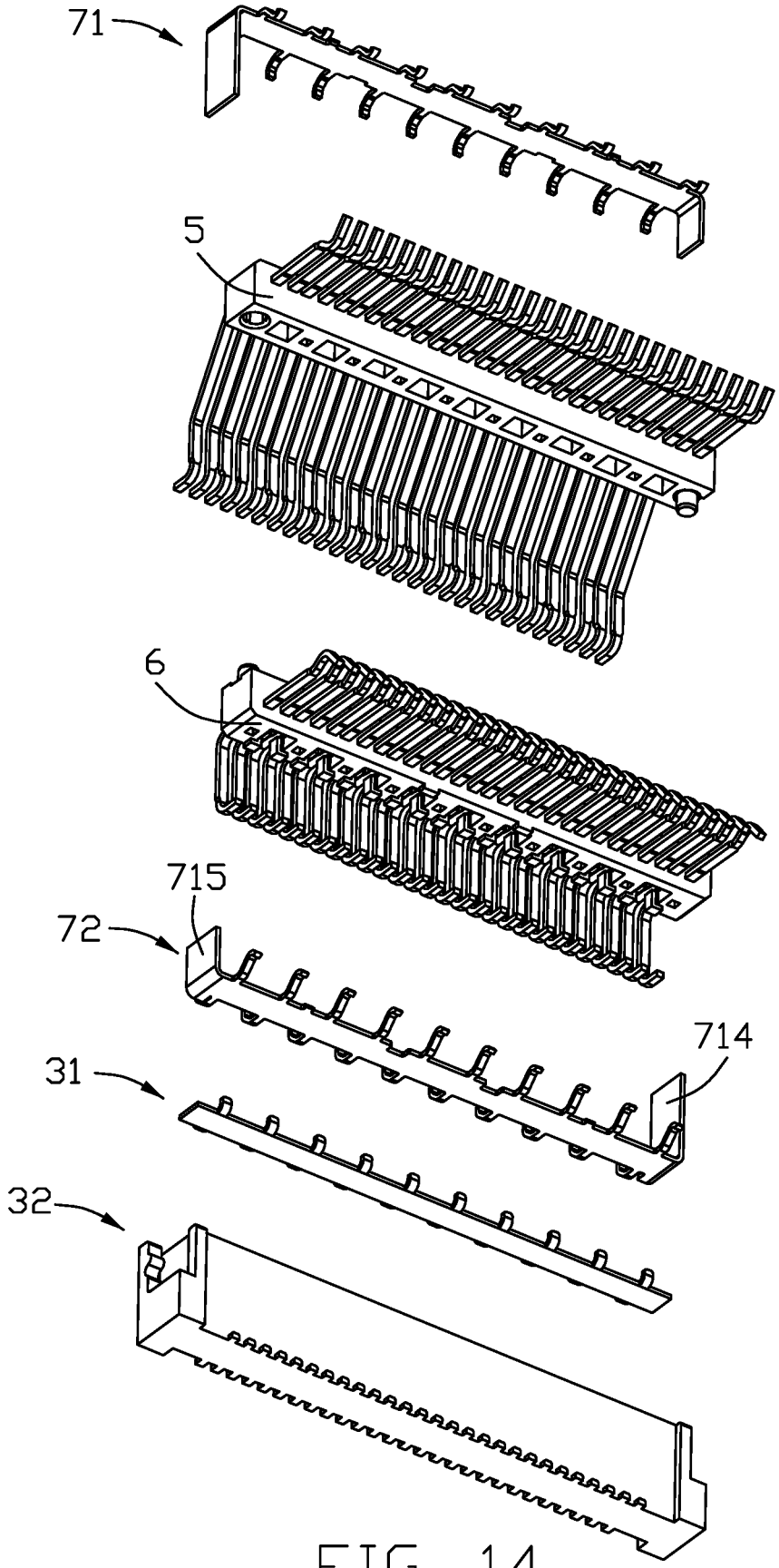
FIG. 14 is a further exploded perspective view of the card edge connector shown in FIG. 12, and the insulating housing is removed.

As best shown in FIGS. 13 and 14, the second grounding member 7 includes two grounding plates, a first grounding plate 71 and a second grounding plate 72, the two grounding plate are symmetrical. Each of the grounding plates 71, 72 includes an elongate plate portion 711 and two end portions 714, 715 bending perpendicularly from two elongate ends of the plate portion 711. The first/front contacting arms 712 extend slantwise and frontwards from the front edge of the plate portion 711 and second/rear contacting arms 713 extend slantwise and rearwards from the rear edge of the plate portion 711. The first and second contacting arms 712, 713 of the first grounding plate 31 press against the grounding terminals of one/upper row of terminals, the first and second contacting arms 712, 713 of the second grounding plate 72 press against the grounding terminals 21 of another/low row of terminals. The first contacting portions are of arc shape while the second contacting portions press with its cutting surfaces.

Two end portions 714, 715 at a same end of the two grounding plates 71, 72 are welded together so as to improve the retaining force of the grounding plates 71, 72 with the insulators 5, 6. One long end portion 714 of the grounding plate is wider than another short end portion 715 in a direction perpendicular to the first and second surface.

Figure 11:
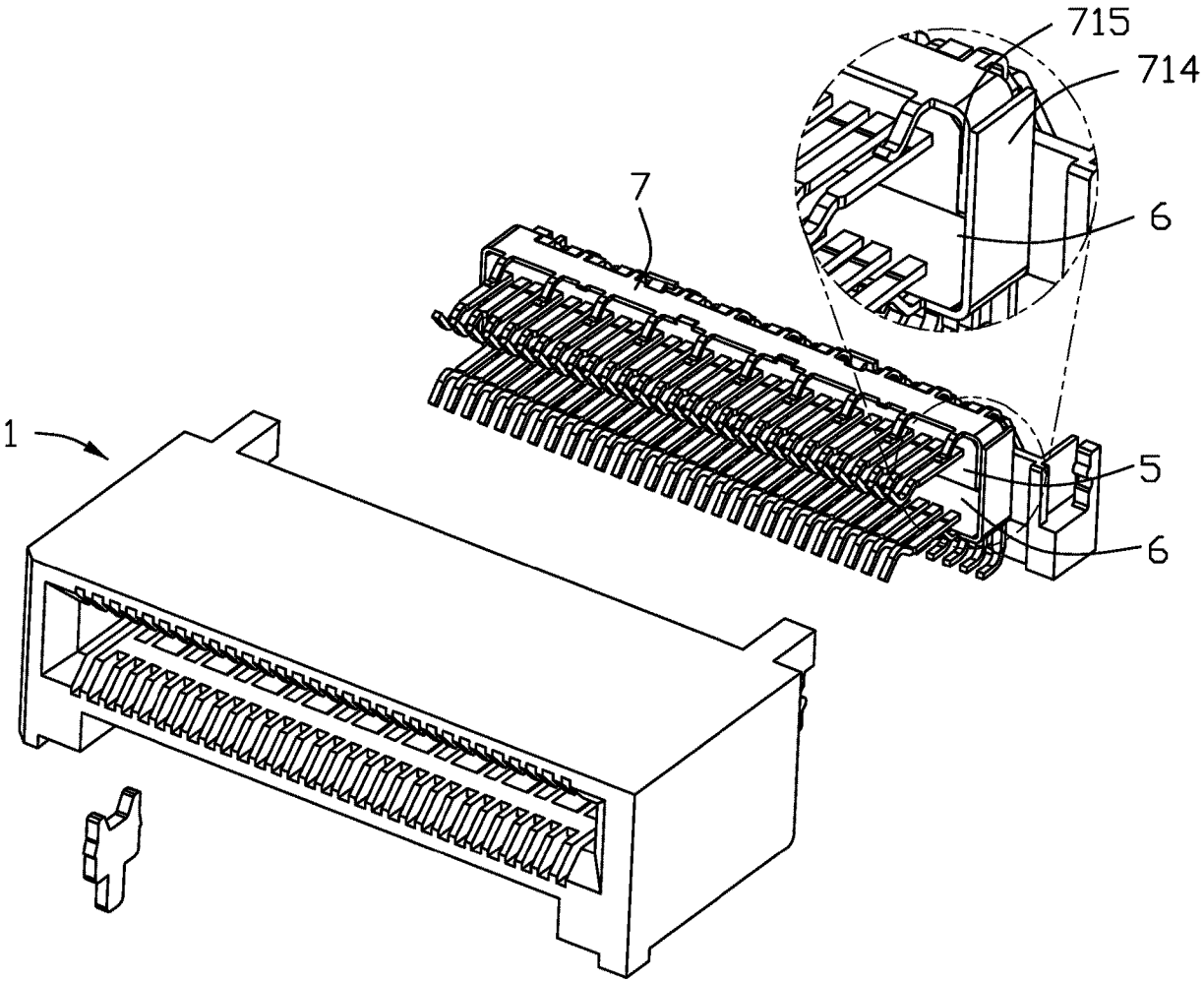
FIG. 11 is an explode perspective view of the card edge connector shown in FIG. 9.

Please notes, the two insulators 5, 6 are slightly offset along the longitudinal direction as best shown in FIG. 11, so that the short end portions 715 press against another insulator. The plate portions of two grounding plates are retained by bosses 222.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A card edge connector, comprising:

an elongate insulating housing defining a card slot between an upper wall and a lower wall;

an upper terminal module with a row of terminals retained in an upper insulator and a lower terminal module with a row of terminals retained in a lower insulator, the upper and lower insulators assembled in the insulating housing, each row of terminals comprising a plurality of signal terminals and a plurality of grounding terminals, the terminals comprising contacting sections exposed upon the card slot, leg sections extending out the insulating housing and connecting sections joining with the contacting sections and the leg sections, respectively; and a retaining part;

wherein the retaining part comprises a grounding member and an insulating base inserting molded with the grounding member, the insulating base are retained at a rear end of the insulating housing and located behind the upper and lower insulators but between the two rows of the terminals, the grounding member comprises two rows of contacting portions extending out the insulating base and contacting with the grounding terminals of the two rows of terminals one by one.

2. The card edge connector as claimed in claim 1, wherein the grounding member comprises an elongate plate embedded in the insulating base and grounding fingers bending from opposite elongate sides of the grounding member, the contacting portions are formed by distal free ends of grounding fingers.

3. The card edge connector as claimed in claim 2, wherein each grounding finger includes a bending portion extending upwards from the elongate side of the elongate plate and the contacting portion extending upwards from the bending portion, the bending portions are embedded in the insulating base.

4. The card edge connector as claimed in claim 1, wherein the connecting sections include upright portions under a condition that the upright sections of the two rows of terminals are disposed offset in a front-to-rear direction and parallel with each other so as to define a space, the insulating base is assembled into the space and the grounding fingers press against the upright sections, respectively.

5. The card edge connector as claimed in claim 4, wherein the insulating housing defines two first retaining portions at a rear end thereof, and the connecting sections are located between the two first retaining portions; the insulating base of the retaining part includes a board portion and two second retaining portions at opposite ends thereof, the board portion is inserted between the two rows of the connecting sections, the second retaining portions are retained with the first retaining portions of the insulating housing.

6. The card edge connector as claimed in claim 5, wherein the first retaining portion defines a slot opening inwards and downwards at a root to the rear end of the insulating housing, the second retaining defines two ribs at a front side thereof, the two ribs are fitly interfered with the slots after the retaining part is assembled upwards.

7. The card edge card connector as claimed in claim 6, wherein the first retaining portion defines projections at a rear end thereof, the second retaining portion defines a locking post with projections engaging with the projections of the first retaining portion.

8. The card edge connector as claimed in claim 2, wherein the grounding terminals are symmetrical about a center axis thereof while the connecting sections of the signal terminals are offset about a center axis thereof.

9. A card edge connector, comprising:

an elongate housing defining a card slot between two opposite long walls and two shot walls;

two rows of terminals disposed in long walls respectively and each row comprising a plurality of signal terminals and a plurality of grounding terminals, the terminals comprising horizontal portions with contacting sections exposed upon the card slot, downward-extending portions bending downwards from the horizontal portions and extending out the insulating housing, the downward-extending sections of the two rows of terminals being arranged offset in a front to rear direction so as to define a space therebetween; and a grounding part;

wherein the grounding part includes an insulating base defining a front surface and a rear surface, and a grounding member retained in the insulating base with a row of first grounding fingers exposed upon the front surface of the insulating base and a row of second grounding fingers exposed upon the rear surface of the insulating base, the insulating base is assembled in the space and the downward-extending portions of terminals are positioned along the front surface and the rear surface, respectively, the first and second grounding fingers press against the downward-extending portions of grounding terminals of the two rows of terminals.

10. The card edge connector as claimed in claim 9, wherein the downward-extending portions of the two rows of terminals comprise upright sections behind the insulating housing, the grounding fingers contact with upright sections.

11. The card edge connector as claimed in claim 9, wherein the a first row of the two rows of terminals is retained in an insulator to form a first terminal module, a second row of the two rows of terminals is retained in an insulator to form a second terminal module, the two insulators are assembled in the elongate housing and between the two long walls.

12. The card edge connector as claimed in claim 10, comprising a first grounding member and a second grounding member, wherein the first grounding member is attached on an upper side of the insulator of the first terminal module and comprises a row of first contacting portion connecting with grounding terminals of the first row of the terminals, the second grounding member is attached on a lower side of the insulator of the second terminal module and comprises a row of first contacting portion connecting with grounding terminals of the second row of the terminals.

13. The card edge connector as claimed in claim 12, wherein the first grounding member comprises a row of second contacting portion connecting with grounding terminals of the first row of the terminals, the second grounding member comprises a row of second contacting portion connecting with grounding terminals of the second row of the terminals, the first and second contacting portions of the first grounding member connect at different points of a same grounding terminal of the first row of the terminals; the first and contact contacting portions of the second grounding member connect at different points of a same grounding terminal of the first row of the terminals.

14. A card edge connector, comprising:

an elongate housing defining a card slot between two opposite long walls and two shot walls;

a terminal module comprising an insulator with two rows of terminals, the two rows of terminals disposed in the long walls, respectively and each row comprising a plurality of signal terminals and a plurality of grounding terminals, the terminals comprising contacting sections exposed upon the card slot, leg sections extending out the insulating housing and connecting sections joining with the contacting sections and the leg sections correspondingly, a first grounding member attached on the insulator and comprising a row of contacting portions connecting with grounding terminals of a first row of the two rows of terminals, respectively;

a second grounding member attached on the insulator and comprising a row of contacting portions connecting with grounding terminals of a second row of the two rows of terminals, respectively;

a third grounding member comprising a front row of contacting portions and a rear row of contacting portions;

wherein the front row of contacting portions of the third grounding member are connecting with the grounding terminals of the first row of the terminals, the rear row of contacting portions are connecting with the grounding terminals of the second row of the terminals.

15. The card edge connector as claimed in claim 14, wherein the first grounding member and the second grounding member are welded together at opposite ends thereof, or made from a one-piece plate.

16. The card edge connector as claimed in claim 14, wherein the third grounding member are retained in an insulating base and the insulating base is assembled at a rear end of the elongate housing.

* * * * *